US012723775B2

(12) United States Patent
Jackson

(10) Patent No.: US 12,723,775 B2
(45) Date of Patent: Sep. 1, 2026

(54) FOUNDATION VENT COVER

(71) Applicant: K&N Engineering, Inc., Riverside, CA (US)

(72) Inventor: Wayne Jackson, Riverside, CA (US)

(73) Assignee: K&N Engineering, Inc., Corona, CA (US)

( * ) Notice: Subject to any disclaimer, the term of this patent is extended or adjusted under 35 U.S.C. 154(b) by 596 days.

(21) Appl. No.: 18/107,836

(22) Filed: Feb. 9, 2023

(65) Prior Publication Data

US 2023/0280068 A1 Sep. 7, 2023

Related U.S. Application Data

(60) Provisional application No. 63/308,726, filed on Feb. 10, 2022.

(51) Int. Cl.
*F24F 13/08* (2006.01)

(52) U.S. Cl.
CPC ..... *F24F 13/084* (2013.01)

(58) Field of Classification Search
CPC ..... F24F 13/082; F24F 13/084; E04B 1/7076; E06B 9/52
See application file for complete search history.

(56) References Cited

U.S. PATENT DOCUMENTS 3,192,849 A 7/1965 Massengale
4,856,575 A * 8/1989 Wells ..... A01K 1/035 29/445
6,581,668 B1 6/2003 Oakley
8,087,981 B2 1/2012 Hoskins
10,926,511 B2 * 2/2021 Chen ..... B32B 5/028
2009/0239462 A1 9/2009 Hendricks
2010/0086358 A1 4/2010 Haryslak

OTHER PUBLICATIONS

PCT Application No. PCT/US2023/012789, International Search Report, May 17, 2023.

* cited by examiner

*Primary Examiner* — Allen R. B. Schult
(74) *Attorney, Agent, or Firm* — Rutan & Tucker LLP; Hani Z. Sayed

(57) ABSTRACT

An apparatus and methods are provided for a foundation vent cover to be installed onto foundation ventilation openings of crawlspaces, garages, and buildings. The foundation vent cover comprises a mesh screen for covering a foundation vent opening and a supportive frame for retaining the mesh screen in an extended configuration over the foundation vent opening. The supportive frame may be made of a metal or any of various plastics. The mesh screen is made of a material that provides an aesthetically appealing appearance to the foundation opening while also allowing an optimal airflow through the foundation opening. The supportive frame includes holes to receive fasteners for attaching the foundation vent cover over the foundation opening. The fasteners may be wood screws, sheet metal screws, self-drilling screws, or threaded bolts and nuts. The holes may be counterbored or countersunk to hide at least a portion of the heads of the fasteners.

2 Claims, 1 Drawing Sheet

FIG. 1
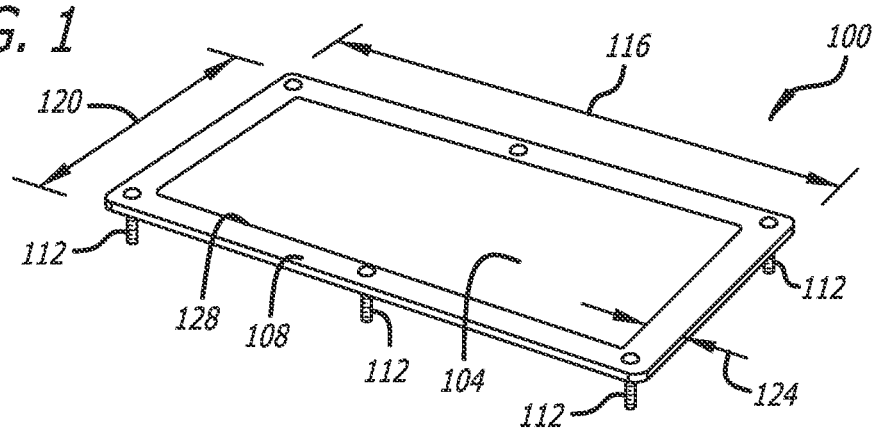
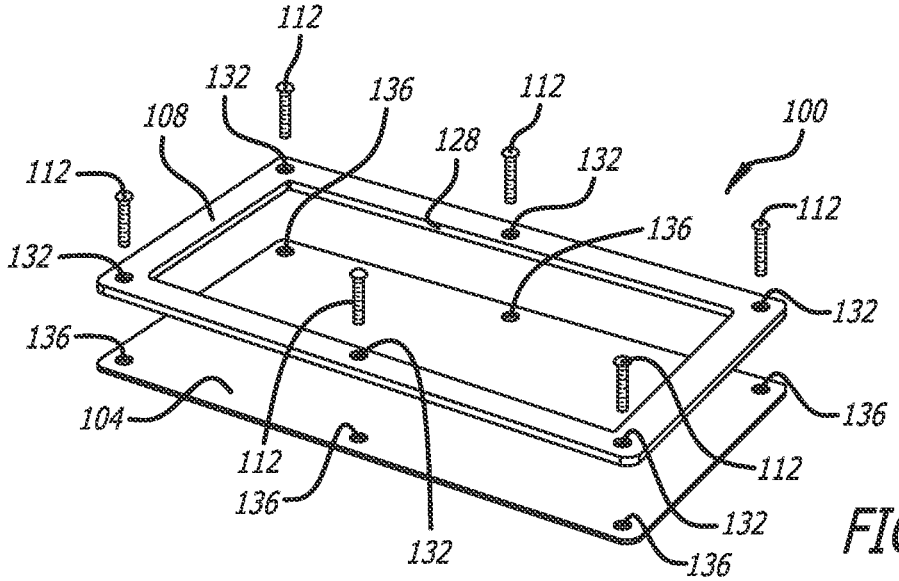
FIG. 2
FIG. 3
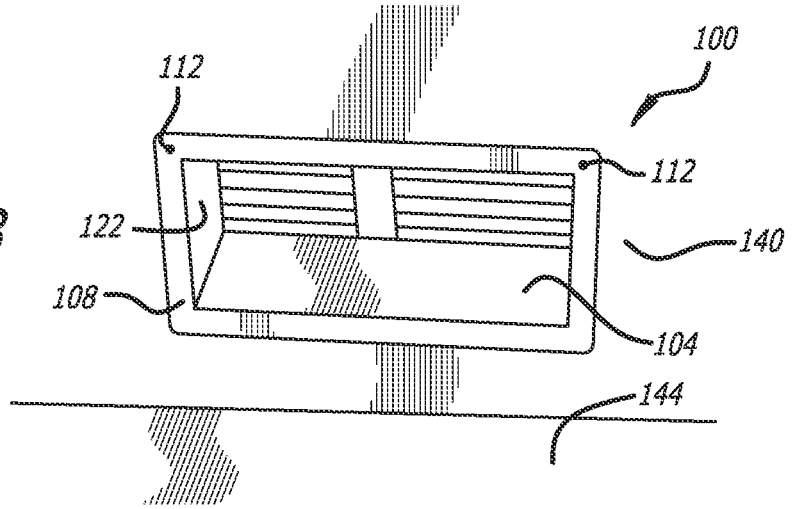

FOUNDATION VENT COVER

PRIORITY

This application claims the benefit of and priority to U.S. Provisional Application, entitled "Foundation Vent Cover," filed on Feb. 10, 2022, and having application Ser. No. 63/308,726, the entirety of said application being incorporated herein by reference.

FIELD

Embodiments of the present disclosure generally relate to foundation ventilation. More specifically, embodiments of the disclosure relate to an apparatus and methods for a foundation vent cover to be installed onto ventilation openings of crawlspaces and garages.

BACKGROUND

Ventilation of a garage or a crawlspace underneath a building is imperative to prevent a build-up of moisture and that can cause damage to structural elements of the building, as well as preventing a build-up of potentially harmful or explosive gasses such as methane, natural gas, ozone, and sewer gas. Foundation vents are designed to be built into foundation walls of a home, garage, or other building to provide reliable ventilation.

In general, a foundation vent includes a frame that is securable within a rectangular opening in a foundation wall. The rectangular shape typically is sized to fit within the space normally occupied by a cinderblock of the foundation wall. The frame typically surrounds and supports a grill structure that allows airflow through the vent but prevents entry by mice, squirrels, chipmunks, and the like. Further, foundation vents generally are provided with a mesh screen mounted to a back side of the grill to prevent relatively small creatures, such as lizards and insects, from entering the garage or crawlspace. Given the ubiquity of foundation vents, there is a desire to provide an aesthetically appealing foundation vent cover that may be installed onto foundation vent openings of crawlspaces and garages.

SUMMARY

An apparatus and methods are provided for a foundation vent cover to be installed onto foundation ventilation openings of crawlspaces, garages, and buildings. The foundation vent cover comprises a mesh screen for covering a foundation vent opening and a supportive frame for retaining the mesh screen in an extended configuration over the foundation vent opening. The supportive frame may be made of a metal or any of various plastics. The mesh screen is made of a material that provides an aesthetically appealing appearance to the foundation opening while also allowing an optimal airflow through the foundation opening. The supportive frame includes holes to receive fasteners for attaching the foundation vent cover over the foundation opening. The fasteners may be wood screws, sheet metal screws, self-drilling screws, or threaded bolts and nuts. The holes may be counterbored or countersunk to hide at least a portion of the heads of the fasteners.

In an exemplary embodiment, a foundation vent cover comprises: a mesh screen for covering a foundation vent opening; a supportive frame for retaining the mesh screen in an extended configuration; and multiple fasteners for attaching the supportive frame around the foundation vent opening.

In another exemplary embodiment, the supportive frame may be made of a rigid material, such as metal or any of various plastics. In another exemplary embodiment, supportive frame has a generally rectangular shape that includes a length and a width adapted for covering a foundation opening. In another exemplary embodiment, the supportive frame comprises a frame width that surrounds and defines an opening that is configured to allow airflow through the mesh screen. In another exemplary embodiment, the frame width has a dimension suitable for retaining the mesh screen disposed over a foundation opening. In another exemplary embodiment, the opening comprises a generally rectangular shape having a length and a width that are defined by the length, the width, and the frame width.

In another exemplary embodiment, the mesh screen comprises a material that provides an aesthetically appealing appearance to the foundation opening while also allowing an optimal airflow through the foundation opening. In another exemplary embodiment, the mesh screen is made of polyester mesh or a similar material. In another exemplary embodiment, the mesh screen is a generally rectangular member having a length and width that are suitable for being supported over the foundation opening by the supportive frame. In another exemplary embodiment, the mesh screen has a length and width that are less than the length and wide of the supportive frame, such that the frame overhangs the edges of the mesh screen. In another exemplary embodiment, an underside of the frame includes a recess configured to accommodate the thickness of the mesh screen.

In another exemplary embodiment, the supportive frame includes multiple holes configured to receive the multiple fasteners for attaching the foundation vent cover over a foundation opening. In another exemplary embodiment, the multiple fasteners comprise any of various hardware fasteners for attaching the foundation vent cover onto a building wall or concrete surrounding the foundation opening. In another exemplary embodiment, the multiple fasteners comprise any of wood screws, sheet metal screws, self-drilling screws, such as zinc-coated steel screws, or threaded bolts and nuts.

In another exemplary embodiment, the holes are distributed around the supportive frame and may be counterbored or countersunk so as to hide at least a portion of the heads of the fasteners. In another exemplary embodiment, the mesh screen includes holes that are concentrically aligned with the holes in the supportive frame. In another exemplary embodiment, the holes enable the fasteners to retain the mesh screen in a flat, unwrinkled disposition within the supportive frame.

In an exemplary embodiment, a method for installing a foundation vent cover onto a foundation opening disposed in a building wall comprises: laying a mesh screen against surrounding edges of the foundation opening; assuring that the mesh screen is disposed in a flat, unwrinkled configuration over the foundation opening; placing a supportive frame over the portion of the mesh screen that is laid against the surrounding edges of the foundation opening; inserting fasteners through holes disposed in the supportive frame and the mesh screen; driving the fasteners into the material comprising the building wall; and tightening the fasteners until the supportive frame retains the mesh screen in the flat, unwrinkled configuration over the foundation opening.

In another exemplary embodiment, placing the supportive frame includes causing the mesh screen to be received into a recess disposed in a backside of the supportive frame. In another exemplary embodiment, placing the supportive frame includes aligning the holes in the frame with the holes in the mesh screen for receiving the fasteners.

These and other features of the concepts provided herein may be better understood with reference to the drawings, description, and appended claims.

BRIEF DESCRIPTION OF THE DRAWINGS

The drawings refer to embodiments of the present disclosure in which:

FIG. 1 illustrates an isometric view of a foundation vent cover, according to the present disclosure;

FIG. 2 illustrates an exploded isometric view of a foundation vent cover in accordance with the present disclosure; and FIG. 3 illustrates an exemplary-use environment wherein an exemplary embodiment of a foundation vent cover is installed onto a foundation vent disposed in a wall of a building, according to the present disclosure.

While the present disclosure is subject to various modifications and alternative forms, specific embodiments thereof have been shown by way of example in the drawings and will herein be described in detail. The present disclosure should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the foundation vent cover and methods disclosed herein may be practiced without these specific details. In other instances, specific numeric references such as "first grill," may be made. However, the specific numeric reference should not be interpreted as a literal sequential order but rather interpreted that the "first grill" is different than a "second grill." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

Ventilation of a garage or a crawlspace underneath a building is imperative to prevent a build-up of moisture and that can cause damage to structural elements of the building, as well as preventing a build-up of potentially harmful or explosive gasses such as methane, natural gas, ozone, and sewer gas. Foundation vents are designed to be built into foundation walls of a home, garage, or other building to provide reliable ventilation. Given the ubiquity of foundation vents, there is a desire to provide an aesthetically appealing foundation vent cover that may be installed onto foundation vent openings of crawlspaces and garages.

FIG. 1 illustrates an isometric view of a foundation vent cover 100, according to the present disclosure. The foundation vent cover 100 comprises a mesh screen 104 disposed within a supportive frame 108, and multiple fasteners 112 for attaching the vent cover 100 onto a foundation vent of a house, garage, or other building structure. The supportive frame 108 may be made of a rigid material, such as metal or any of various plastics. The supportive frame 108 has a generally rectangular shape that includes a length 116 and a width 120 adapted for covering a foundation opening 122, as shown in FIG. 3. In some embodiments, the length 116 is about 16 inches while the width 120 is about 8.5 inches. In other embodiments, however, the length 116 may be lesser than or greater than 16 inches and the width 120 may be lesser than or greater 8.5 inches, without limitation, depending on the size and shape of the foundation opening 122 onto which the vent cover 100 is to be installed.

As shown in FIG. 2, the supportive frame 108 comprises a frame width 124 that surrounds and defines an opening 128 that is configured to allow airflow through the mesh screen 104. The frame width 124 may have any dimension suitable for retaining the mesh screen 104 disposed over a foundation opening 122, as desired. In the embodiment shown herein, the frame width 124 is substantially 1.0 inches, without limitation. The opening 128 comprises a generally rectangular shape having a length and a width that are defined by the length 116, the width 120, and the frame width 124, without limitation. It is contemplated that any one or more of the length 116, the width 120, and the frame width 124 may be adapted according to size and shape of the opening onto which the vent cover 100 is to be installed. In the illustrated embodiment, for example, the length 116, the width 120, and the frame width 124 give the opening 128 a size and shape that are suitable for covering a typical cinderblock-sized foundation opening 122, and thus the opening 128 has a length of the about 14 inches and a width of about 6.5 inches.

The mesh screen 104 comprises a material that provides an aesthetically appealing appearance to the foundation opening 122 while also allowing an optimal airflow through the foundation opening 122. As such, the mesh screen 104 may be made of polyester mesh or similar material, without limitation. Further, the mesh screen 104 is a generally rectangular member having a length and width that are suitable for being supported over the foundation opening 122 by the frame 108. In some embodiments, the mesh screen 104 has a length of about 15.61 inches and a width of about 8.11 inches. As will be appreciated, the mesh screen 104 preferably has a length and width that are less than the length 116 and wide 120 of the supportive frame 108, such that the frame 108 overhangs the edges of the mesh screen 104, as shown in FIG. 1. In some embodiments, an underside of the frame 108 may include a recess configured to accommodate the thickness of the mesh screen 104, such that the combination of the frame 108 and the mesh screen 104 may be laid flush against a flat surface.

As shown in FIGS. 1-2, the supportive frame 108 includes multiple holes 132 configured to receive fasteners 112 suited for attaching the vent cover 100 over a foundation opening 122, as shown in FIG. 3. The fasteners 112 may comprise any of various hardware fasteners for attaching the vent cover 100 onto a building wall or concrete surrounding the foundation opening 122. For example, the fasteners 112 may comprise any of wood screws, sheet metal screws, self-drilling screws, such as zinc-coated steel screws, or threaded bolts and nuts, without limitation. The holes 132 preferably are uniformly distributed around the supportive frame 108 and may be counterbored or countersunk so as to hide at least a portion of the heads of the fasteners 112. Further, the mesh screen 104 includes holes 136 that are concentrically aligned with the holes 132 in the supportive frame 108. As will be appreciated, the holes 136 enable the fasteners 112 to retain the mesh screen 104 in a flat, unwrinkled disposition within the supportive frame 108.

FIG. 3 illustrates an exemplary-use environment wherein an exemplary embodiment of a foundation vent cover 100 is installed onto a foundation opening 122 disposed in a wall 140 near a foundation 144 of a building, garage, or other structure, according to the present disclosure. As shown in FIG. 3, the foundation opening 122 comprises a rectangular shape that may be covered by the foundation vent cover 100. The mesh screen 104 is laid against surrounding edges of the foundation opening 122 such that the mesh screen 104 is disposed in a flat, unwrinkled configuration over the opening 122. The supportive frame 108 is placed over the portion of the mesh screen 104 that is laid against the surrounding edges of the foundation opening 122. Preferably, the mesh screen 104 is received into a recess disposed in a backside of the supportive frame 108 such that the supportive frame 108 lays flush against the wall 140 and the holes 136 are concentrically aligned with the holes 132. The fasteners 112 are inserted through the holes 132, 136 and driven into the material comprising the wall 140. Once tightened, the fasteners 112 and the support frame 108 retain the mesh screen 104 in the flat, unwrinkled configuration over the foundation opening 122, as shown in FIG. 3.

While the foundation vent cover and methods have been described in terms of particular variations and illustrative figures, those of ordinary skill in the art will recognize that the foundation vent cover is not limited to the variations or figures described. In addition, where methods and steps described above indicate certain events occurring in certain order, those of ordinary skill in the art will recognize that the ordering of certain steps may be modified and that such modifications are in accordance with the variations of the foundation vent cover. Additionally, certain of the steps may be performed concurrently in a parallel process when possible, as well as performed sequentially as described above. To the extent there are variations of the foundation vent cover, which are within the spirit of the disclosure or equivalent to the foundation vent cover found in the claims, it is the intent that this patent will cover those variations as well. Therefore, the present disclosure is to be understood as not limited by the specific embodiments described herein, but only by scope of the appended claims.

What is claimed is:

1. A foundation vent cover, comprising:

a mesh screen for covering a foundation vent opening wherein the mesh screen has a length and width that are less than the length and wide of the supportive frame, such that the frame overhangs the edges of the mesh screen;

a foundation vent cover having at least a supportive frame; whereby the supportive frame having a frame width that surrounds and defines an opening that is configured to allow airflow through the mesh screen and that further allows for retaining the mesh screen in an extended configuration;

the support frame including a plurality of holes to attach the foundation vent cover over a foundation opening; the plurality of holes are configured to concentrically align with a plurality of holes on the mesh screen;

the mesh screen comprised of a polyester mesh;

the opening comprises a rectangular shape having a length and a width that are defined by the length, width and the supportive frame width; and multiple fasteners for attaching the supportive frame around the foundation vent opening.

2. The foundation vent cover of claim 1 wherein an underside of the frame includes a recess configured to accommodate the thickness of the mesh screen.

* * * * *